US007472977B2

(12) United States Patent
Fujimoto et al.

(10) Patent No.: US 7,472,977 B2
(45) Date of Patent: Jan. 6, 2009

(54) PRINTING APPARATUS AND PRINTING METHOD

(75) Inventors: Yasunori Fujimoto, Tokyo (JP); Makoto Akahira, Yokoham (JP)

(73) Assignee: Cannon Kabushiki Kaisha, Tokyo (JP)

( * ) Notice: Subject to any disclaimer, the term of this patent is extended or adjusted under 35 U.S.C. 154(b) by 231 days.

(21) Appl. No.: 11/439,217

(22) Filed: May 24, 2006

(65) Prior Publication Data

US 2006/0274097 A1 Dec. 7, 2006

(30) Foreign Application Priority Data

Jun. 1, 2005 (JP) ..... 2005-161423

(51) Int. Cl.
*B41J 29/38* (2006.01)

(52) U.S. Cl. ..... 347/13

(58) Field of Classification Search ..... None
See application file for complete search history.

(56) References Cited

U.S. PATENT DOCUMENTS

| | | | | |
|---|---|---|---|---|
| 6,808,249 | B1 | 10/2004 | Kneezel et al. | 347/43 |
| 2004/0185693 | A1 * | 9/2004 | Yamaguchi et al. | 439/79 |
| 2005/0260021 | A1 * | 11/2005 | Abello | 400/62 |

FOREIGN PATENT DOCUMENTS

| | | |
|---|---|---|
| EP | 1 405 722 | 4/2004 |
| JP | 8-72245 | 3/1996 |

* cited by examiner

*Primary Examiner*—Julian D Huffman
(74) *Attorney, Agent, or Firm*—Fitzpatrick, Cella, Harper & Scinto

(57) ABSTRACT

A printing apparatus executes printing by arranging plural printheads, each including a plurality of print elements in a direction of a print width so as to obtain the print width corresponding to a width of a printing medium and conveying the printing medium in a direction perpendicular to the direction of the print width. The printing positions of part of the print elements of a first printhead in the direction of the print width overlap with part of the print elements of a second printhead in the direction of the print width. The apparatus includes a conveyor for conveying the printing medium, a mutual complementary printer performing mutual complementary printing in the overlap portion by the overlapped print elements, and a time divisional driving controller for dividing the plurality of print elements of each of the plural printheads into a plurality of blocks, with each block composed of a predetermined number of print elements, and for time-divisionally driving the predetermined number of print elements included in each block. The predetermined number differs from a number of print elements included in the overlap portion, and the time divisional driving controller controls the driving sequences of the overlapped print elements of the plural printheads to coincide with each other.

9 Claims, 18 Drawing Sheets

PRINTING APPARATUS AND PRINTING METHOD

FIELD OF THE INVENTION

This invention relates to a printing apparatus and printing method and, more particularly, to a printing apparatus and printing method of executing printing by, e.g., causing a full-line printhead employing inkjet method including a plurality of orifices to discharge ink droplets to a printing medium.

BACKGROUND OF THE INVENTION

In recent years, OA equipment such as a computer, word-processor, and copying machine are becoming popular, and many printing apparatuses to be used for this equipment have been developed. Especially, inkjet printing apparatuses are superior to printing apparatuses employing other printing methods because of the easily attainable high resolution, high operation speed, quietness, and low cost. Recent OA equipment are required to be capable of color printing. To meet this requirement, a lot of color inkjet printing apparatuses have also been developed.

An inkjet printing apparatus discharges ink from nozzles to a printing medium, thereby forming an image. Particularly, to increase the print speed, a printhead with a plurality of ink orifices and liquid channels being integrated is used as a printhead in which a plurality of print elements are integrated and arrayed. A printing apparatus coping with color printing generally comprises a plurality of printheads (to be referred to as a multi-head hereinafter).

For color image printing, various factors such as color development, tonality, and uniformity must be taken into consideration, unlike monochrome printers that print only characters and numbers. Especially as for the uniformity, slight variations in nozzle to nozzle in the multi-head manufacturing process influence the amount and direction of ink discharge from each nozzle during color image printing. This finally appears as density unevenness in an image, resulting in a poor image quality.

A detailed example will be described with reference to the accompanying drawings.

FIG. 17 is a view showing an image density when ink is properly discharged. FIG. 18 is a view showing an image density when errors occur in an ink discharge amount and direction.

Referring to FIGS. 17 and 18, reference numeral 91 denotes a printhead; 92, an ink discharge nozzle (to be referred to as a nozzle hereinafter); 93, an ink droplet discharged from the nozzle 92; 94, a printing medium; and 95, a printed dot formed on the printing medium.

When all nozzles discharge ink droplets with the same size in the same direction, as indicated by a in FIG. 17, the printed dots 95 with the same size are formed on the printing medium 94, as indicated by b in FIG. 17. As a result, a uniform image without density unevenness is obtained as a whole, as indicated by c in FIG. 17.

In fact, the discharge amount and direction vary between the nozzles, as described above. Hence, if printing is executed without any correction, the size and discharge direction of the ink droplets 93 discharged from the nozzles 92 vary, as indicated by a in FIG. 18. Consequently, the printed dots 95 are formed on the printing medium 94 in different sizes or at unexpected positions, as indicated by b in FIG. 18. According to b in FIG. 18, a blank portion (a portion without printed dots) exists in the nozzle array direction, or conversely, the printed dots 95 overlap more than necessary to increase the printing density. Alternatively, a white stripe is formed, as can be seen at the center of b in FIG. 18. The set of printed dots formed in this manner shows a density distribution indicated by c in FIG. 18 in regard to the nozzle array direction.

As a result, the density variation is normally perceived as density unevenness by the human eye.

To solve the density unevenness, a method of executing divisional printing by repeatedly scanning a printhead in the same region of a printing medium and a method of executing divisional printing by disposing a plurality of printheads have been proposed conventionally.

As a head structure including a plurality of printheads, a so-called dual head structure in a serial printer and a structure having a so-called full-line printhead with a print width corresponding to the width of a printing medium in a line printer are known.

To achieve high-speed printing highly demanded recently, a line type inkjet printing apparatus is also known which comprises a full-line printhead having a print width equal to or more than the width of a printing medium and limits relative movement of the printhead and printing medium to one.

Full-line printheads include an "integrated line type" printhead having a full-line print width by one print element substrate on which nozzle arrays for discharging ink are arranged, and a "bonded-head line type" printhead which increases the print width by bonding a plurality of print element substrates with a short print width.

Even for the "bonded-head line type" printhead, many methods of arraying print element substrates are known. For example, print element substrates are arranged in a line at an interval to form one printhead. A region between the print element substrates where no printing is performed is printed by using another printhead. Alternatively, a printhead using a so-called "overlap" method is known in which print element substrates are arrayed to execute printing in the same region by the plurality of print element substrates provided on one printhead.

In a printhead which has an array of a plurality of print elements each having an ink orifice and an electrothermal transducer for generating discharge energy to discharge ink from the ink orifice, power required for driving these print elements is large. Hence, a time divisional driving method is widely known which divides a plurality of print elements into a plurality of blocks and sequentially drives the blocks (e.g., Japanese Patent Publication Laid-Open No. 8-72245).

According to this method, for example, a plurality of print elements are put into one block. Several or several ten driving integrated circuits each capable of simultaneously driving one print element in one block are arranged on a single substrate. Image data corresponding to the print elements is input, and the driving integrated circuits are time-divisionally driven, desired printing on a printing medium such as a printing paper sheet can be executed. In such time divisional driving, if adjacent print elements are driven simultaneously, the liquid channels mutually suffer pressure interference by pressure generated upon ink discharge. The printing density may change due to the pressure interference (crosstalk). Hence, it is desirable that simultaneous or continuous driving of adjacent print elements is inhibited, as is conventionally known.

To achieve high-quality printing by the conventional line type inkjet printing apparatus that implements high-speed printing, it is supposed to be effective to arrange a plurality of printheads and execute divisional printing by using the plurality of printheads. However, from the viewpoint of the cost, size, and power consumption of the printing apparatus, the number of the plurality of printheads is practically two or four at most.

Some of the conventional serial type inkjet printing apparatuses employ a multi-pass printing method using eight passes or more. It is difficult to implement an image quality equal to or better than that of the serial type by using a line type printhead.

SUMMARY OF THE INVENTION

Accordingly, the present invention is conceived as a response to the above-described disadvantages of the conventional art.

For example, a full-line type printing apparatus and printing method according to the present invention are capable of implementing high-quality printing.

According to one aspect of the present invention, preferably, there is provided a printing apparatus for executing printing by time-divisionally driving a printhead including a plurality of print elements in a direction of a print width so as to obtain the print width corresponding to a width of a printing medium and conveying the printing medium in a direction perpendicular to the direction of the print width, comprising: conveyance means for conveying the printing medium; mutual complementary printing means, under condition that at least part of the plurality of print elements in the printhead are overlapped in a conveyance direction of the printing medium, for performing mutual complementary printing in the overlap portion by the overlapped print elements; and time divisional driving control means for, upon time-divisionally driving the overlapped print elements used for mutual-complementarily printing, adjusting driving sequences of the overlapped print elements.

The apparatus may be arranged to have at least two printheads each including the plurality of print elements in the conveyance direction of the printing medium.

In this case, the time divisional driving control means preferably divides the plurality of print elements included in a first printhead of the at least two printheads into a plurality of blocks, divides the plurality of print elements included in a second printhead of the at least two printheads into a plurality of blocks such that the number of print elements included in each block is equal to that in the first printhead, and controls to make the driving sequences of the plurality of print elements belonging to the plurality of blocks coincident between the first printhead and the second printhead.

Preferably, the first printhead and the second printhead form one set, and the printheads belonging to the set discharge the same color ink.

Furthermore, four sets may be provided in the conveyance direction of the printing medium, and printheads belonging to the four sets may execute color printing by discharging black ink, magenta ink, cyan ink, and yellow ink, respectively.

The printhead may be a so-called "integrated line type" printhead which is formed by providing the plurality of print elements on one print element substrate.

The printhead may be a so-called "bonded-head line type" printhead formed by bonding a plurality of print element substrates each including print elements smaller in number than the plurality of print elements.

In the "bonded-head line type" printhead, driving control is preferably executed such that a joint between the plurality of print element substrates matches an end of the block for time divisional driving.

In the "bonded-head line type" printhead, a so-called "overlap" method may be employed in which a plurality of print element arrays each including a plurality of print elements are formed in one printhead, and at least some of the plurality of print element arrays are overlapped in the conveyance direction of the printing medium.

To discharge ink by using thermal energy, the printhead preferably comprises an electrothermal transducer to generate the thermal energy to be given to the ink.

According to another aspect of the present invention, preferably, there is provided a printing method of executing printing by time-divisionally driving a printhead including a plurality of print elements in a direction of a print width so as to obtain the print width corresponding to a width of a printing medium and conveying the printing medium in a direction perpendicular to the direction of the print width, comprising: a mutual complementary printing step, under condition that at least part of the plurality of print elements in the printhead are overlapped in a conveyance direction of the printing medium, of performing mutual complementary printing in the overlap portion by the overlapped print elements; and a time divisional driving control step of, upon time-divisionally driving the overlapped print elements used for mutual-complementarily printing, adjusting driving sequences of the overlapped print elements.

The invention is particularly advantageous since printed dots can be arrayed in order on a printing medium, and high-quality image printing can be achieved.

Other features and advantages of the present invention will be apparent from the following description taken in conjunction with the accompanying drawings, in which like reference characters designate the same or similar parts throughout the figures thereof.

BRIEF DESCRIPTION OF DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

Constituent elements described in the following embodiments are merely illustrative, and the scope of the invention is not limited to them.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "printing element (sometimes referred to as "nozzle")" generally means a set of a discharge orifice, a liquid channel connected to the orifice and an element to generate energy utilized for ink discharge.

<Basic Arrangement of Printing Apparatus (FIG. 1)>

Figure 1:
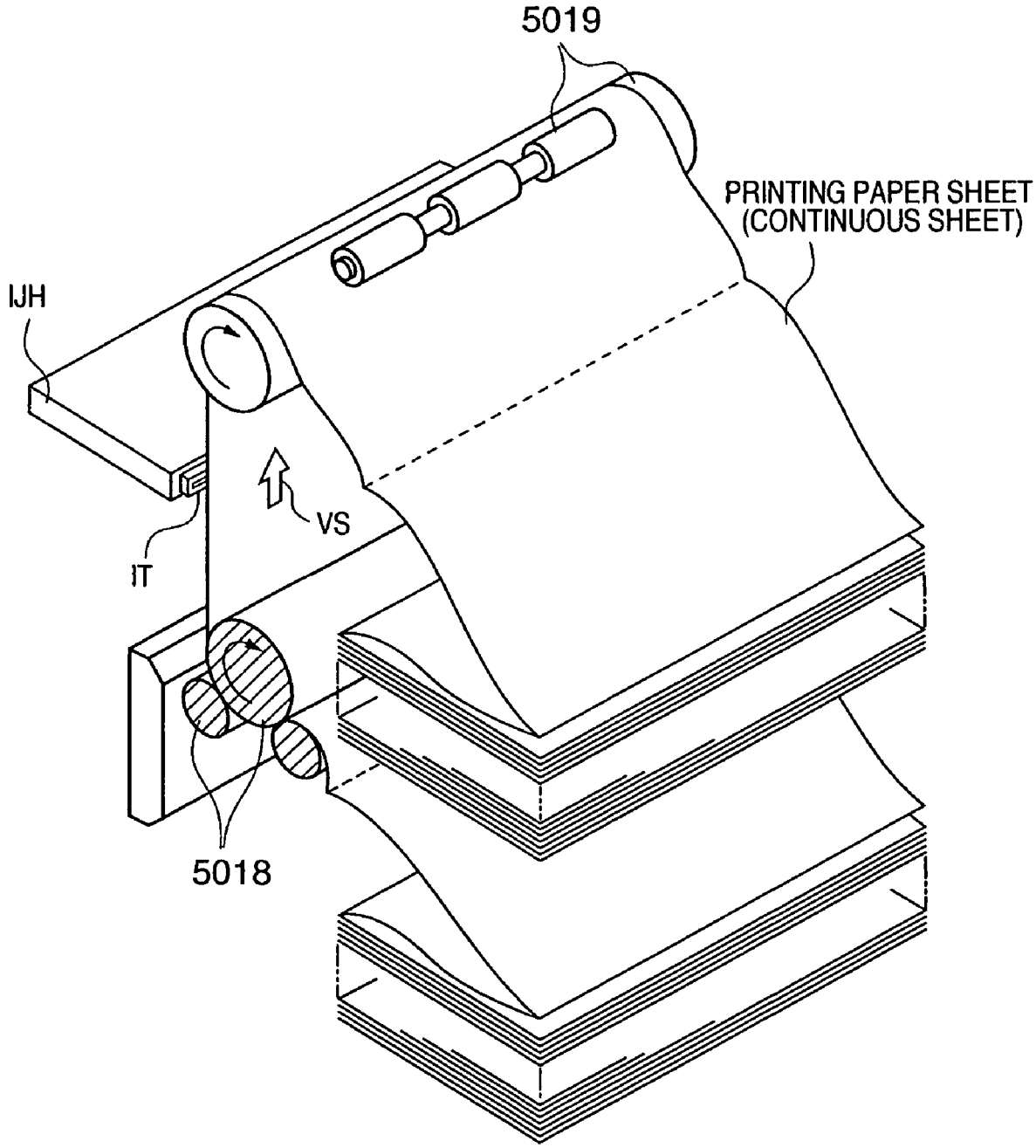
FIG. 1 is an outer perspective view showing the arrangement of the main part of an inkjet printer IJRA according to a typical embodiment of the present invention.

FIG. 1 is an outer perspective view showing the arrangement of the main part of an inkjet printer IJRA according to a typical embodiment of the present invention. In the inkjet printer of this embodiment, a printhead (full-line printhead) IJH that discharges ink is arrayed in the conveyance direction of a printing paper sheet over the range of full width of a printing medium such as a continuous printing paper sheet P, as shown in FIG. 1. Ink is discharged from an orifice IT of the printhead IJH to the printing paper sheet P at a predetermined timing.

In this embodiment, the printing paper sheet P as a foldable continuous sheet is conveyed in a direction VS in FIG. 1 by driving a conveyance motor under the control of a control circuit (to be described below) so that an image is printed on the printing paper sheet. Referring to FIG. 1, reference numeral 5018 denotes conveyance rollers. Discharge-side rollers 5019 hold the printing paper sheet P as a continuous sheet at the print position together with the conveyance rollers 5018 and convey the printing paper sheet P in the direction of the arrow VS interlockingly with the conveyance rollers 5018 driven by a driving motor (not shown).

FIG. 1 shows an arrangement for monochrome printing which comprises one full-line printhead IJH that discharges black (K) ink. For color printing, at least four full-line printheads are provided along the conveyance direction of the printing paper sheet in correspondence with at least yellow (Y) ink, magenta (M) ink, cyan (C) ink, and black (K) ink used for color printing.

The arrangement may comprise, e.g., two full-line printheads that discharges the same color ink for high-quality printing or high-speed printing. This arrangement will be described in detail in the following some embodiments.

The printing medium to be used in the printing apparatus may be either a continuous sheet as shown in FIG. 1 or a cut sheet.

<Control Configuration of Printing Apparatus (FIG. 2)>

Figure 2:
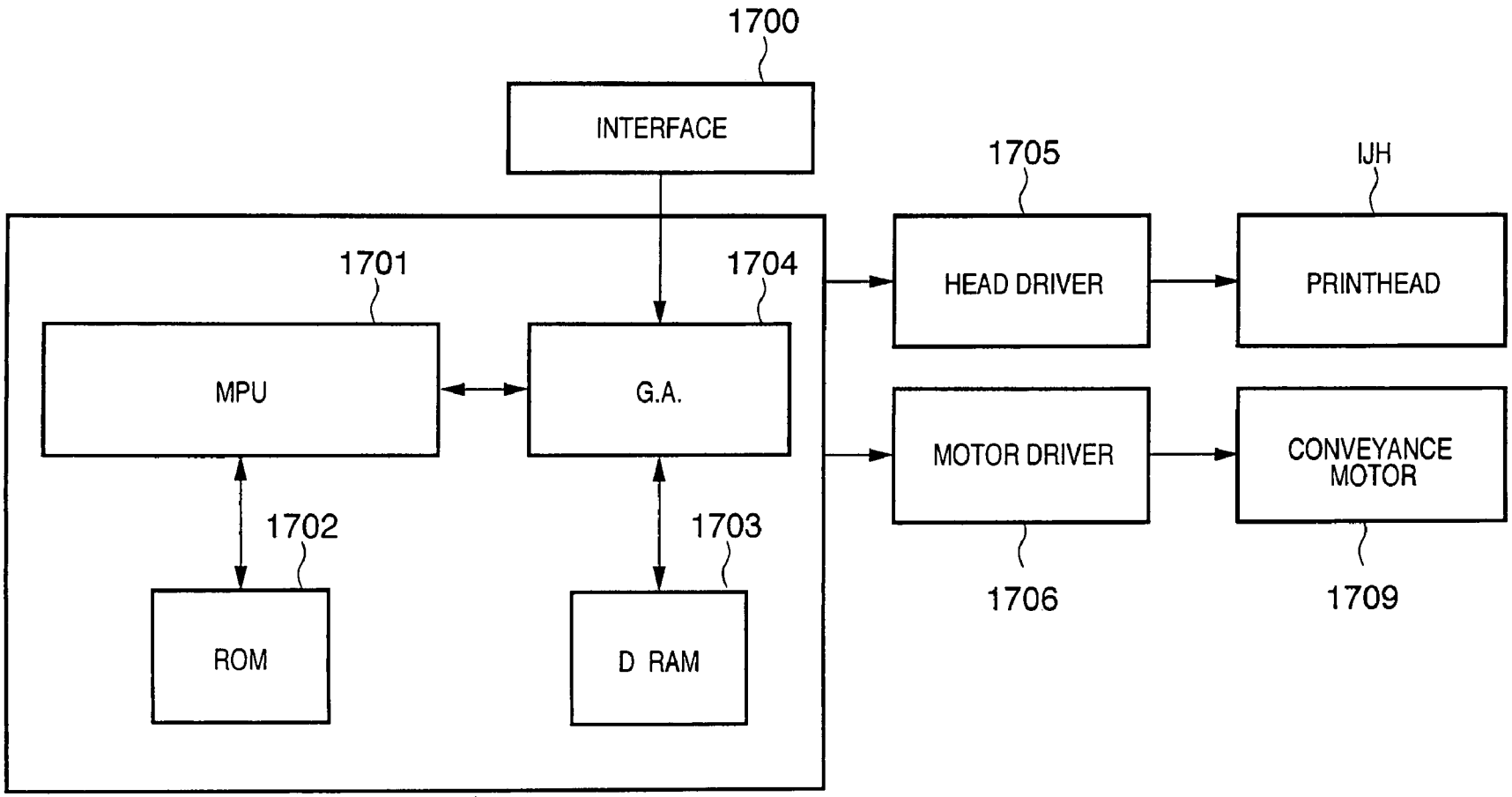
FIG. 2 is a block diagram showing the control configuration of the printing apparatus shown in FIG. 1.

FIG. 2 is a block diagram showing the control configuration of the printing apparatus shown in FIG. 1.

Referring to FIG. 2, reference numeral 1700 denotes an interface that inputs a print signal from an external device such as a host computer; 1701, an MPU; 1702, a ROM that stores a control program (including character fonts as needed) to be executed by the MPU 1701; and 1703, a DRAM that temporarily saves various kinds of data (e.g., the print signal and print data to be supplied to the printhead). A gate array (G.A.) 1704 controls print data supply to the printhead IJH and data transfer between the interface 1700, MPU 1701, and RAM 1703. A conveyance motor 1708 conveys a printing paper sheet (a continuous sheet in this embodiment). A-head driver 1705 drives the printhead IJH. A motor driver 1706 drives the conveyance motor 1708.

The outline of the operation of the control circuit will be described. When a print signal is input to the interface 1700, the print signal is converted to print data for printing between the gate array 1704 and the MPU 1701. The motor driver 1706 is driven. In addition, the printhead IJH is driven in accordance with the print data sent to the head driver 1705 so that a printing operation is executed.

Some embodiments of the type, layout, and driving method of a full-line printhead used in a printing apparatus having the above-described arrangement will be described next.

First Embodiment

A printing apparatus which comprises two full-line printheads (to be referred to as printheads hereinafter) for discharging black ink and executes monochrome printing will be described.

Figure 3:
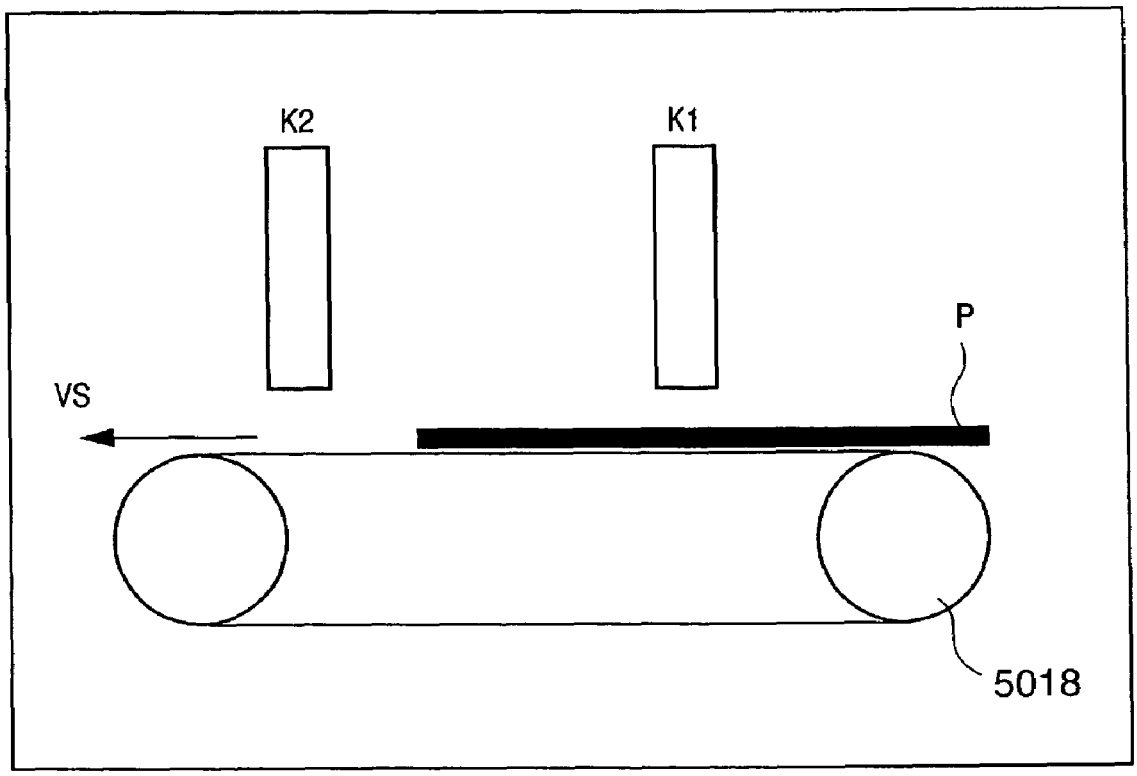
FIG. 3 is a side sectional view of a printing apparatus so as to indicate the layout of full-line printheads according to the first embodiment.

FIG. 3 is a side sectional view of the printing apparatus so as to indicate the layout of full-line printheads.

As shown in FIG. 3, by driving a conveyor belt and a conveyance roller 5018, a printing paper sheet P is conveyed in a direction indicated by an arrow VS. The printing paper sheet P is made to pass under a first printhead K1 and then under a second printhead K2 capable of printing using the same color ink as that of the first printhead K1. When the printing paper sheet P is located under the first printhead K1, printing is performed by discharging ink from the first printhead K1. When the printing paper sheet P is located under the second printhead K2, printing is performed by discharging ink from the second printhead K2.

Simultaneously as a part of the printing paper sheet P is printed by the first printhead K1, another part of the printing paper sheet P may be printed by the second printhead K2.

Figure 4:
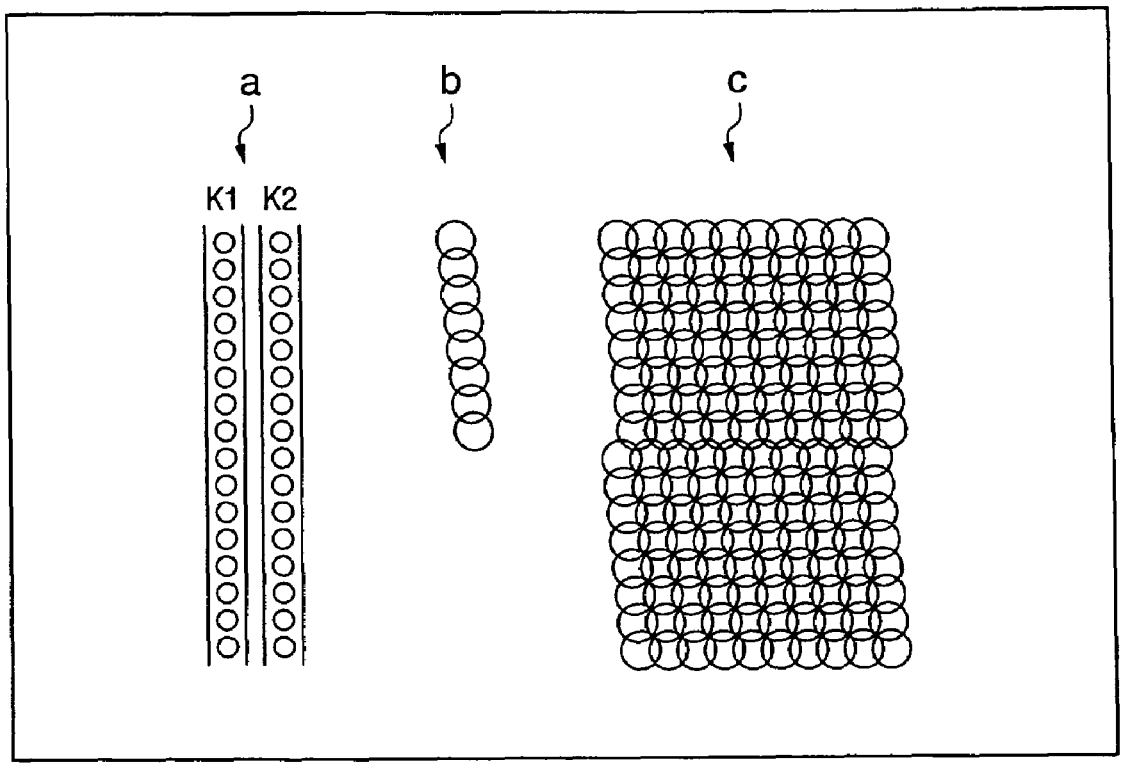
FIG. 4 is a view showing printing using two printheads K1 and K2 according to the first embodiment.

FIG. 4 is a view showing the concept of a printing method using the two printheads K1 and K2.

The two printheads shown in FIG. 4 constitute a so-called "integrated line type" printhead which has no joint on a single substrate because nozzle arrays for discharging ink are arranged on the single print element substrate so that a full-line print width is obtained by the single print element substrate, as described in the prior art.

As indicated by a in FIG. 4, each of the first printhead K1 and second printhead K2 has one nozzle array including a plurality of nozzle groups. In each nozzle group, nozzles are arrayed at an interval of about 1/1200 inch so that printing can be performed at a resolution of about 1,200 dpi. Since the printing apparatus has two printheads that discharge the same color ink, as described with reference to FIG. 3, printing of two cycles can be done at the resolution of about 1,200 dpi.

In each printhead, eight nozzles are put in one group, as indicated by b in FIG. 4. In the group, the eight nozzles are sequentially driven. For this reason, the printed dot layout on a printing medium has a pattern at an eight-nozzle period, as indicated by c in FIG. 4.

As an example of the driving sequence, the eight nozzles of each group are driven sequentially from an end of the group. However, any other driving sequence obtained by the permutations and combinations of the eight nozzles may be employed. In the above-described example, eight nozzles are driven as a group. However, the number of nozzles in a group is not limited to eight and may be larger or smaller.

When printing on a printing medium is to be done by using two printheads that discharge the same color ink, the print region is set such that printed dots printed from the first printhead and those printed from the second printhead have a mutually complementary relationship. Upon such printing, an image of higher quality can be obtained by making the nozzle driving sequences of the two printheads in time divisional driving coincident.

This advantage will be described in comparison with a case where the nozzle driving sequences of two printheads in time divisional driving are not coincident in the same arrangement as described above.

Figure 5:
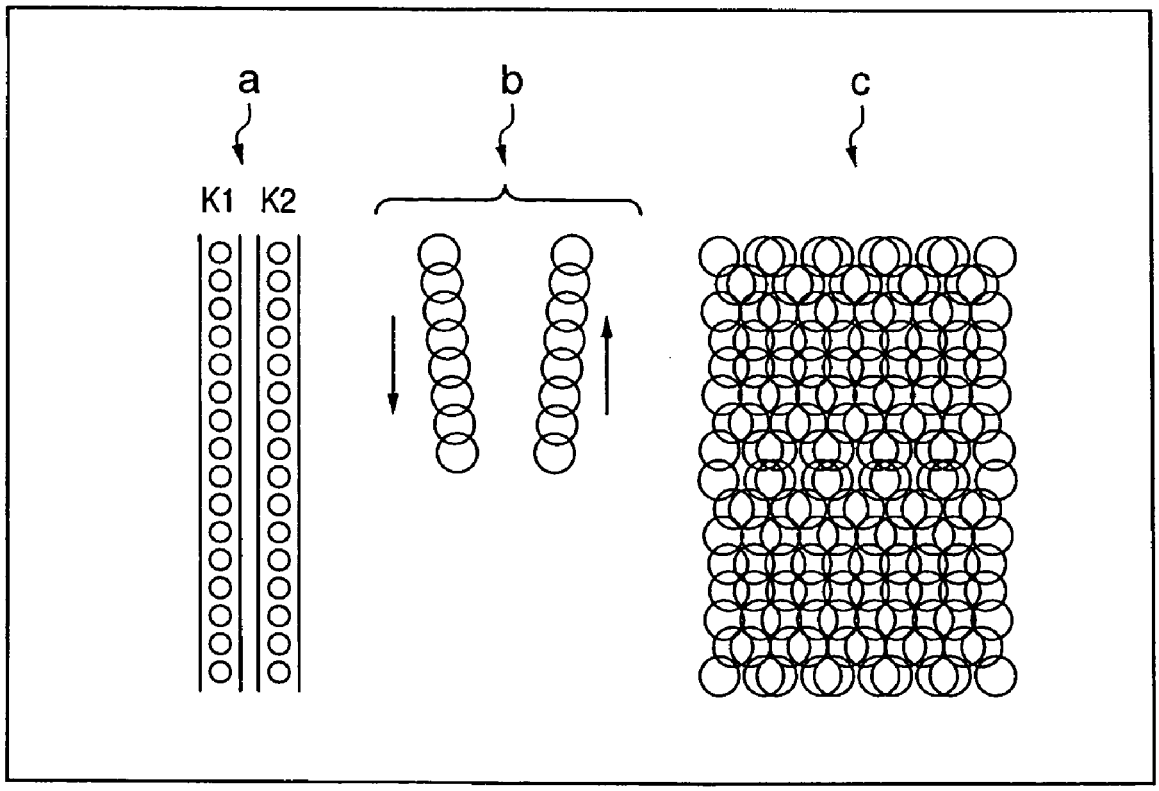
FIG. 5 is a view showing printing that is executed by the same arrangement as in the printing apparatus shown in FIG. 3 without adjusting the nozzle driving sequences of two printheads in time divisional driving.

FIG. 5 is a view showing the concept of a printing method of the same arrangement as that of the printing apparatus shown in FIG. 3 without making the nozzle driving sequences of the two printheads in time divisional driving coincident.

As indicated by a in FIG. 5, the layout of the printheads is the same as in FIG. 4. Although the number of nozzles included in one nozzle group is the same, the driving sequence differs between time divisional driving of the first printhead K1 and that of the second printhead K2. As indicated by b in FIG. 5, nozzles included on one nozzle group of the printhead K1 are driven sequentially from the upper end to the lower end. However, nozzles included on one nozzle group of the printhead K2 are driven sequentially from the lower end the upper end. As a result, printed dots corresponding to one nozzle group are bilaterally symmetrical.

When printing is mutual-complementarily performed by using the two printheads, the resultant printed dots are not arrayed in order, as indicated by c in FIG. 5. For this reason, the quality of the printed image is poorer than c in FIG. 4.

In the example shown in FIG. 5, the driving sequences between the two printheads are symmetrical. However, if the time divisional driving of the first printhead is even slightly different from that of the second printhead, the shift of that portion becomes more noticeable, and the quality of the printed image degrades. The printed image quality also degrades when the number of nozzles in one nozzle group differs between the two printheads.

In the above-described embodiment, an arrangement that execute monochrome printing by using two printheads that discharge the same color ink has been exemplified. However, the printing apparatus may execute monochrome printing by using three or more printheads that discharge the same color ink. This arrangement can also be extended to a printing apparatus for executing color printing.

Figure 6:
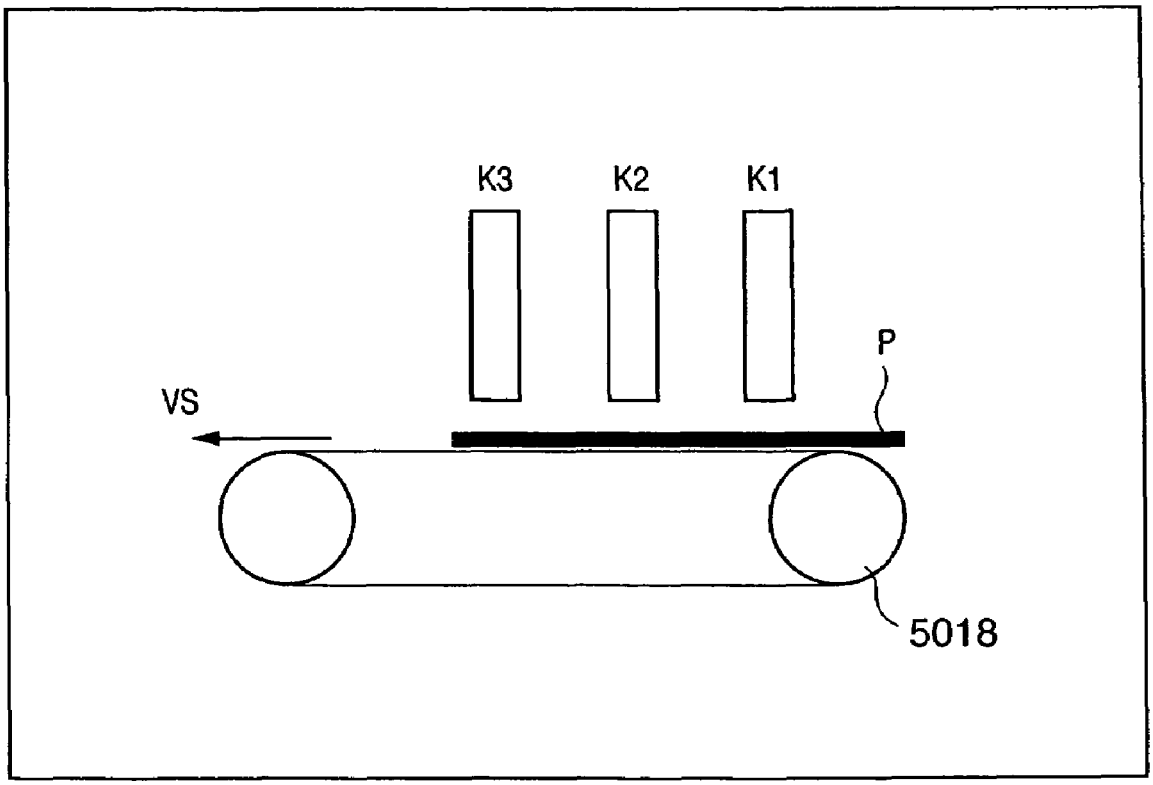
FIG. 6 is a side sectional view of a printing apparatus so as to indicate the layout of three full-line printheads that discharge black ink.

FIG. 6 is a side sectional view of a printing apparatus so as to indicate the layout of three full-line printheads that discharge black ink.

As shown in FIG. 6, when printing is done by distributing print image data to the three printheads that discharge the same color ink while making the nozzle driving sequences of the three printheads in time divisional driving coincident, printed dots are arrayed in order. Hence, the quality of the printed image becomes high.

Figure 7:
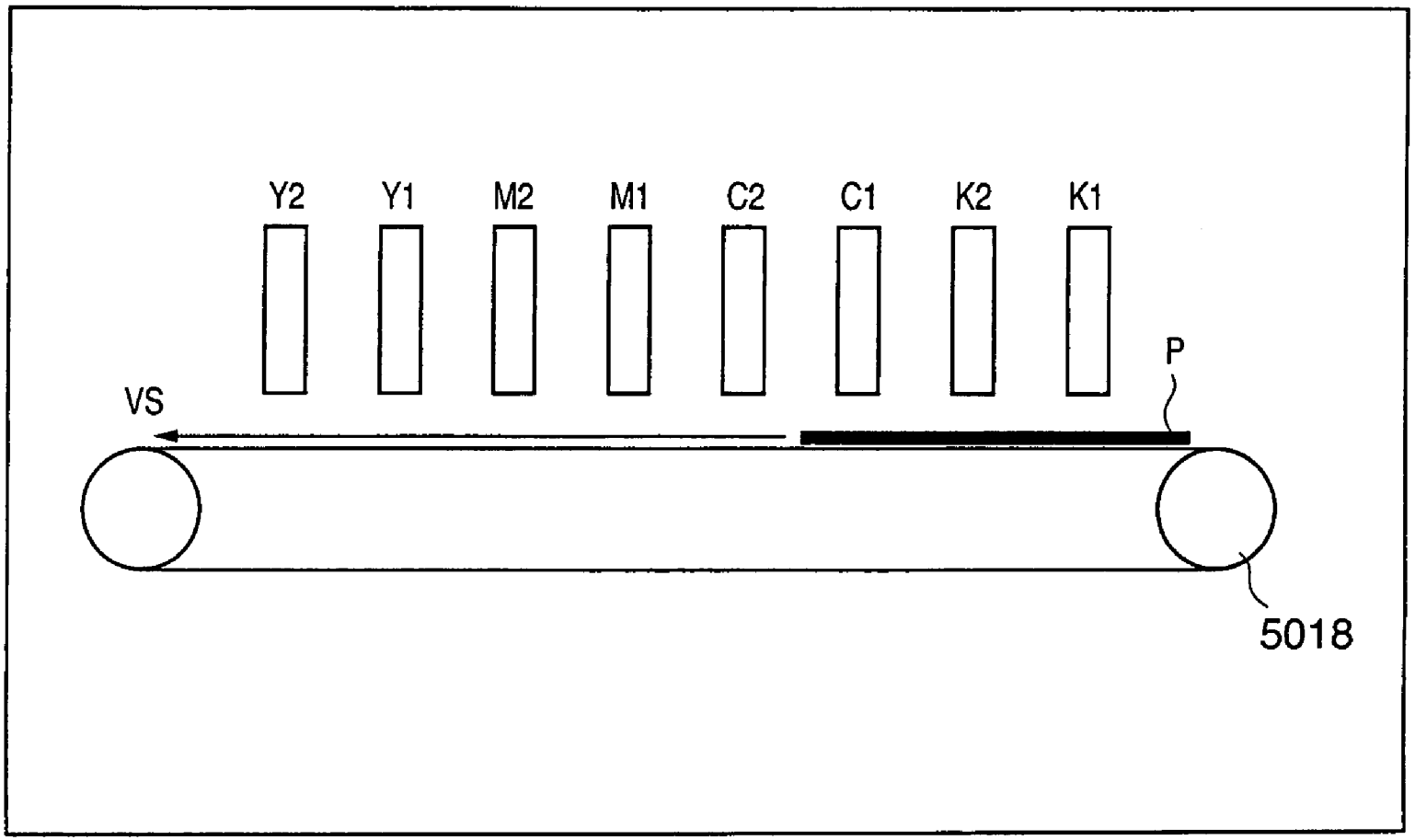
FIG. 7 is a side sectional view of a printing apparatus so as to indicate the layout of pairs of full-line printheads that discharge Y ink, M ink, C ink, and K ink.

FIG. 7 is a side sectional view of a printing apparatus so as to indicate the layout of pairs of full-line printheads that discharge Y ink, M ink, C ink, and K ink.

As shown in FIG. 7, this arrangement includes four pairs of printheads, i.e., a total of eight printheads whose each pair discharges the same color ink. A high-quality color image can be printed by making the driving sequences of two printheads that discharge the same color ink in time divisional driving coincident, as described above.

First Modification to First Embodiment

Figure 8:
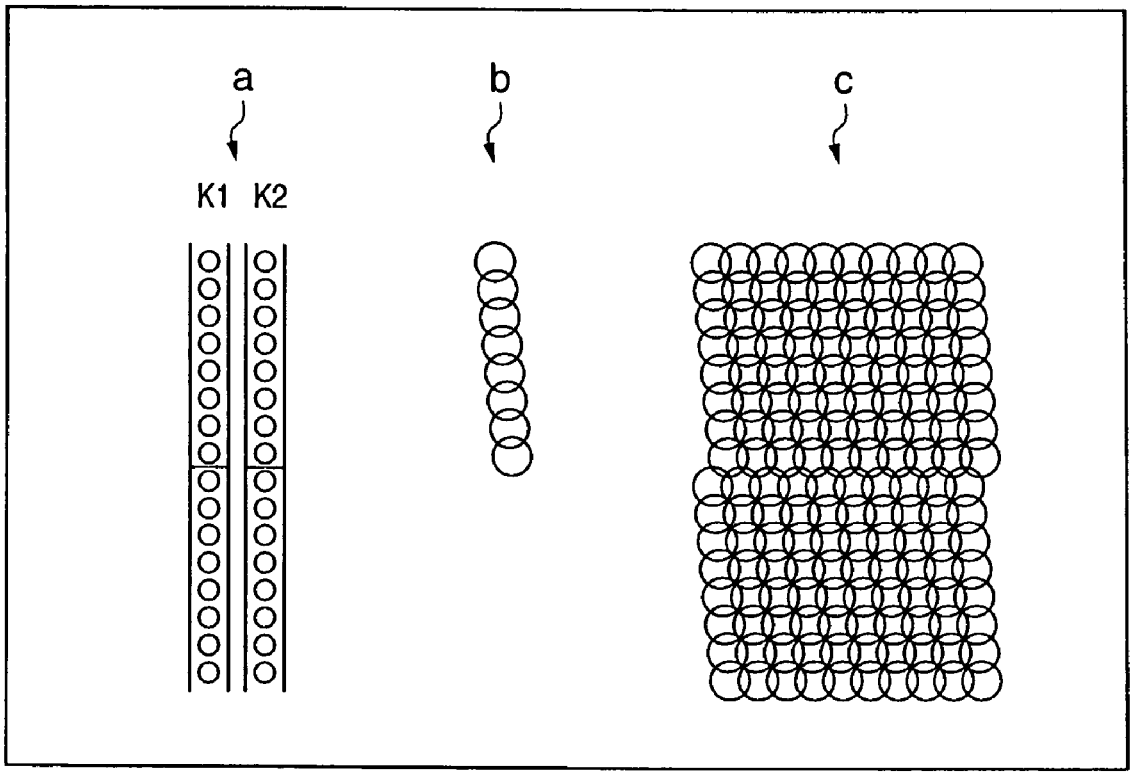
FIG. 8 is a view showing printing using the two printheads K1 and K2 according to the first modification to the first embodiment.

FIG. 8 is a view showing printing using the two printheads K1 and K2.

Each printhead shown in FIG. 8 is a so-called "bonded-head line type" printhead which is formed by bonding a plurality of print element substrates with a short print width to increase the print width, as described in the prior art, as compared to FIG. 4. Although the nozzle arrangement and nozzle group arrangement are the same as those shown in FIG. 4, joints are present between the nozzle groups.

The positional relationship between the two printheads K1 and K2 is determined such that the joints between the nozzle groups are located at the same positions on a printing medium between the two printheads.

When mutual complementary printing is to be executed by the two printheads, time divisional driving of the two printheads is arranged by, e.g., repeating the pattern indicated by b in FIG. 8. In this case, printed dots by the two printheads are arrayed in order, as indicated by c in FIG. 8, and high-quality printing can be achieved.

Second Modification to First Embodiment

Figure 9:
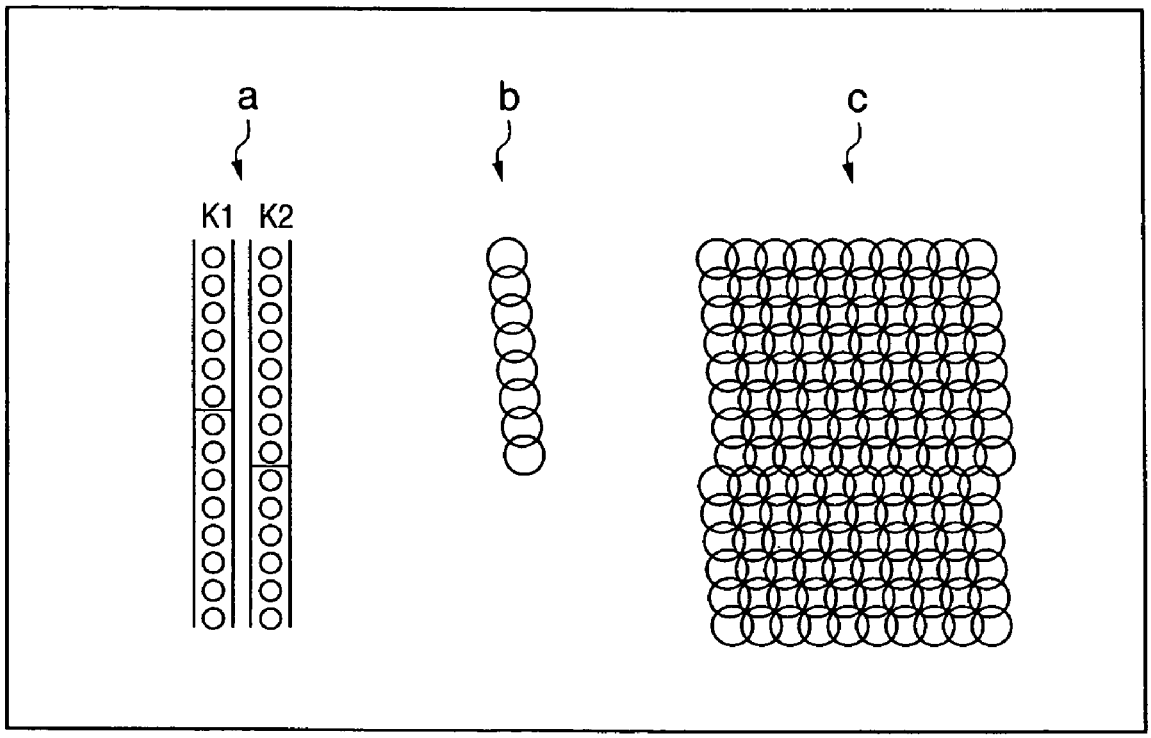
FIG. 9 is a view showing printing using the two printheads K1 and K2 according to the second modification to the first embodiment.

FIG. 9 is a view showing printing using the two printheads K1 and K2.

Each printhead shown in FIG. 9 is a so-called "bonded-head line type" printhead which is formed by bonding a plurality of print element substrates with a short print width to increase the print width, as described in the prior art, as compared to FIG. 4. Although the nozzle arrangement and nozzle group arrangement are the same as those shown in FIG. 4, joints are present between the nozzle groups. As is apparent from a comparison between a in FIG. 9 and a in FIG. 8, the positional relationship between the two printheads is determined such that the joints between the nozzle groups are located at different positions on a printing medium between the two printheads.

When mutual complementary printing is to be executed by the two printheads, time divisional driving of the two printheads is arranged by, e.g., repeating the pattern indicated by b in FIG. 9. In this case, printed dots by the two printheads are arrayed in order, as indicated by c in FIG. 9, and high-quality printing can be done.

Figure 10:
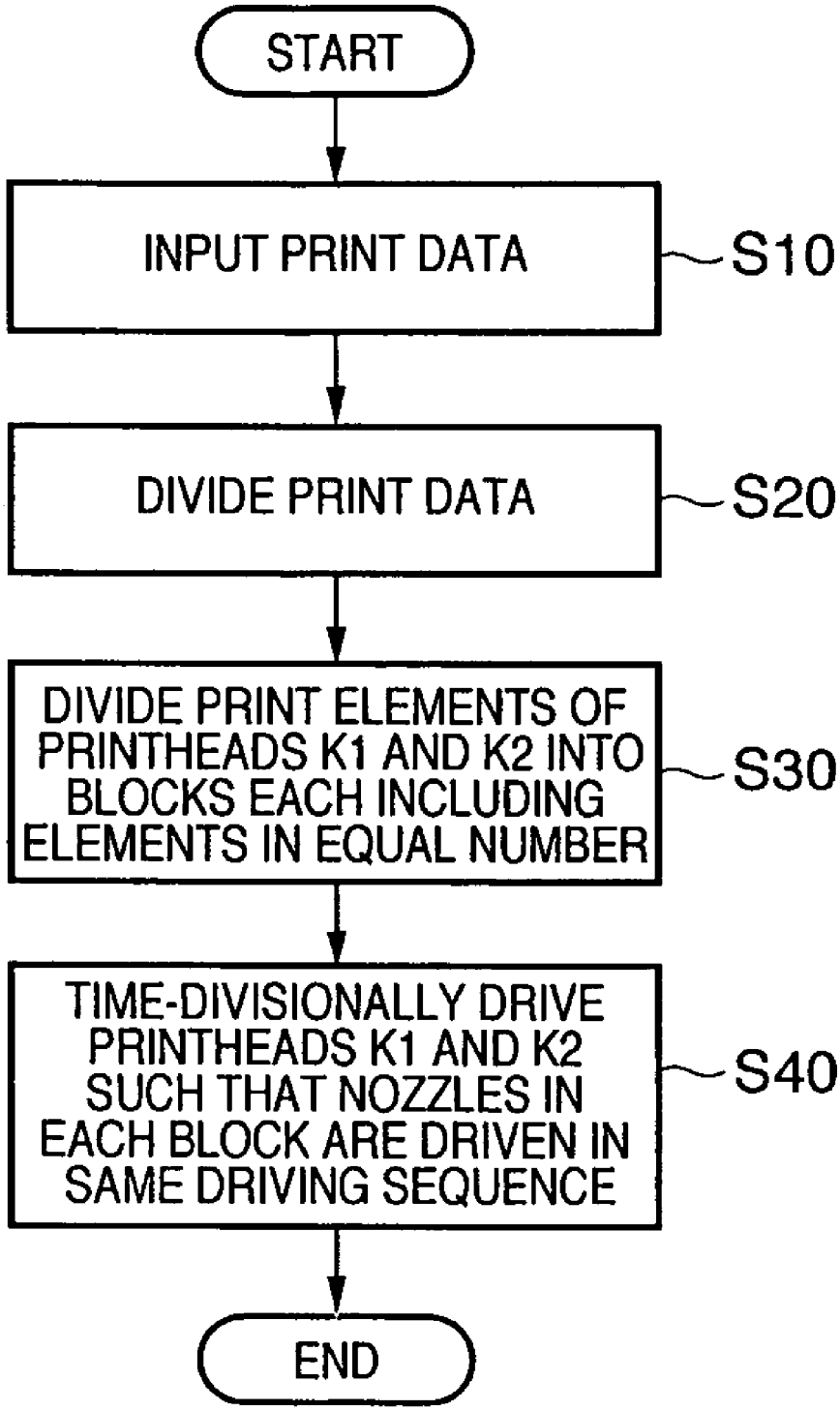
FIG. 10 is a flowchart showing the concept of a printing method according to the first embodiment.

The printing methods corresponding to the above-described various types of printheads and their layouts are summarized in the flowchart shown in FIG. 10.

This flowchart describes a printing-method for the two printheads K1 and K2 that discharge the same color ink. However, the present invention is not limited to this. For example, the present invention can also be applied to three or more printheads that discharge the same color ink and an arrangement having, e.g., eight printheads that discharge Y, M, C, and K inks. The present invention can also be applied to a "bonded-head line type" printhead by adjusting the blocks to place each joint to an end of a time divisional block.

In step S10, print data of one line is input. For printing of the same color ink, mutual complementary printing is executed by two printheads. Hence, in step S20, the input print data is distributed to the two printheads.

In step S30, the print elements of the printheads K1 and K2 are divided into blocks each including elements in equal number. In step S40, the printheads K1 and K2 are time-divisionally driven such that nozzles in each divided block are driven in the same driving sequence.

According to the above-described embodiment, printed dots that are complementarily printed using two or more printheads that discharge the same color ink are arrayed in order on a printing medium. Hence, high-quality printing can be executed.

Second Embodiment

In this embodiment, a printing method of a printing apparatus that uses a "bonded-head line type" printhead employing an "overlap" printing method will be described. For the descriptive convenience, a printing apparatus for executing monochrome printing by using a single printhead that discharges black ink will be exemplified.

Figure 11:
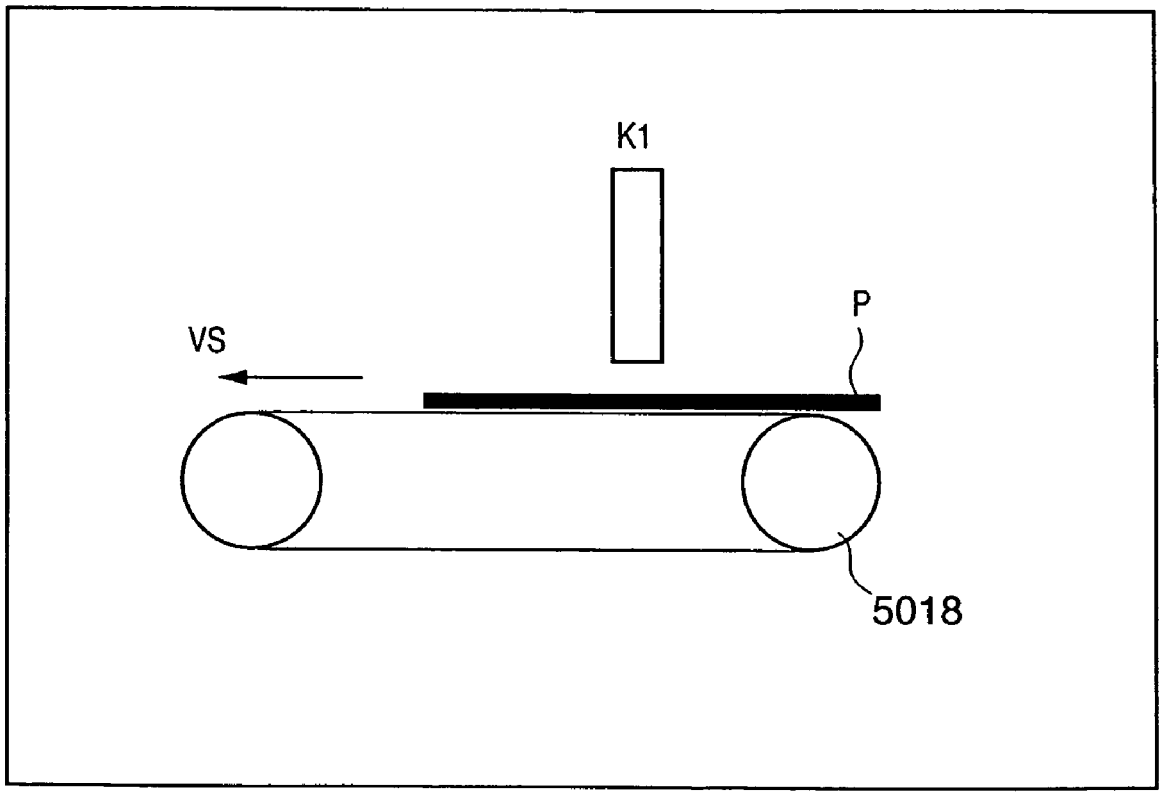
FIG. 11 is a side sectional view of a printing apparatus so as to indicate the layout of a full-line printhead according to the second embodiment.

FIG. 11 is a side sectional view of a printing apparatus so as to indicate the layout of a full-line printhead. As is apparent from FIG. 11, only one printhead is used here.

As shown in FIG. 11, by driving a conveyor belt and a conveyance roller 5018, a printing paper sheet P is conveyed in a direction indicated by an arrow VS. When the printing paper sheet P is located under a printhead K1, printing is performed by discharging ink from the printhead K1.

Figure 12:
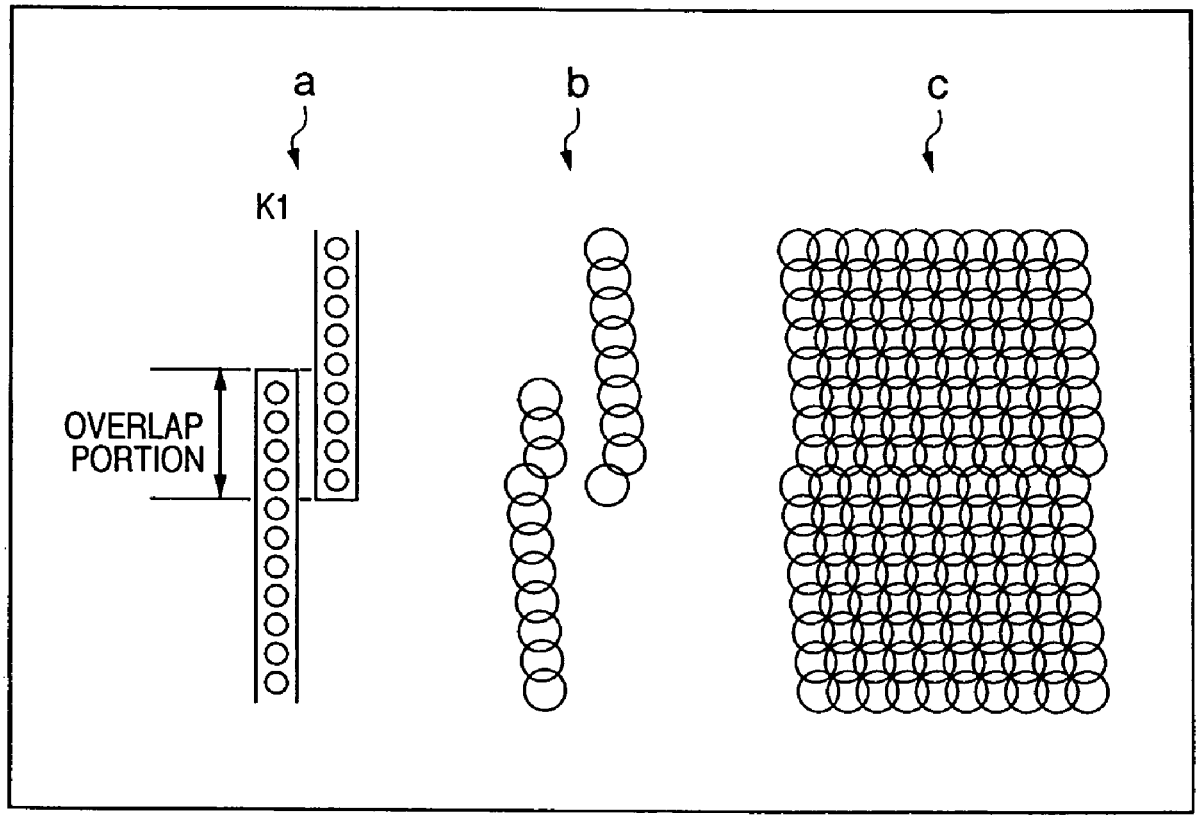
FIG. 12 is a view showing the relationship between nozzle arrays and printed dots.

FIG. 12 is a view showing the relationship between nozzle arrays and printed dots.

The printhead K1 according to this embodiment has a plurality of nozzle arrays (two arrays in FIG. 12) each including a plurality of nozzle groups, as indicated by a in FIG. 12. At the joint portion between the nozzle arrays, the nozzle arrays are partially overlapped so as to perform printing at the same position on a printing medium. In mutual complementary printing by the two nozzle arrays, time divisional driving of the nozzle arrays is controlled in the following manner. For example, the driving sequences of the print elements are arranged in the overlap portion such that printed dots are formed as indicated by b in FIG. 12. In this case, the printed dots formed in the overlap portion are arrayed in order, as indicated by c in FIG. 12. Hence, high-quality printing is achieved.

Figure 13:
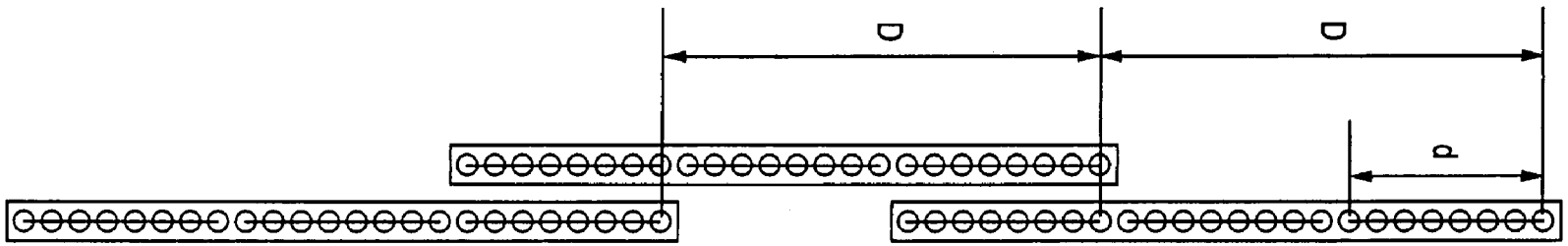
FIG. 13 is a view showing an example of the relationship between the print width of a nozzle group, the print width of a nozzle array, and the print width of an overlap portion.

If the same type of print element substrates are mass-produced and arrayed to form a full-line printhead for cost reduction, the following procedure is employed. That is, when the print width of each nozzle array is defined as a distance D that corresponds to an integer multiple of a print width d of a nozzle group included in each block for time divisional driving, and print element substrates are arrayed such that the overlap portion has the print width d, as shown in FIG. 13, the printhead can easily be manufactured. If different print element substrates are produced, the array method is not limited to the above-described method.

A printing will be described in comparison with a case where the nozzle driving sequences of two printheads in time divisional driving are not coincident in the same arrangement as described above.

Figure 14:
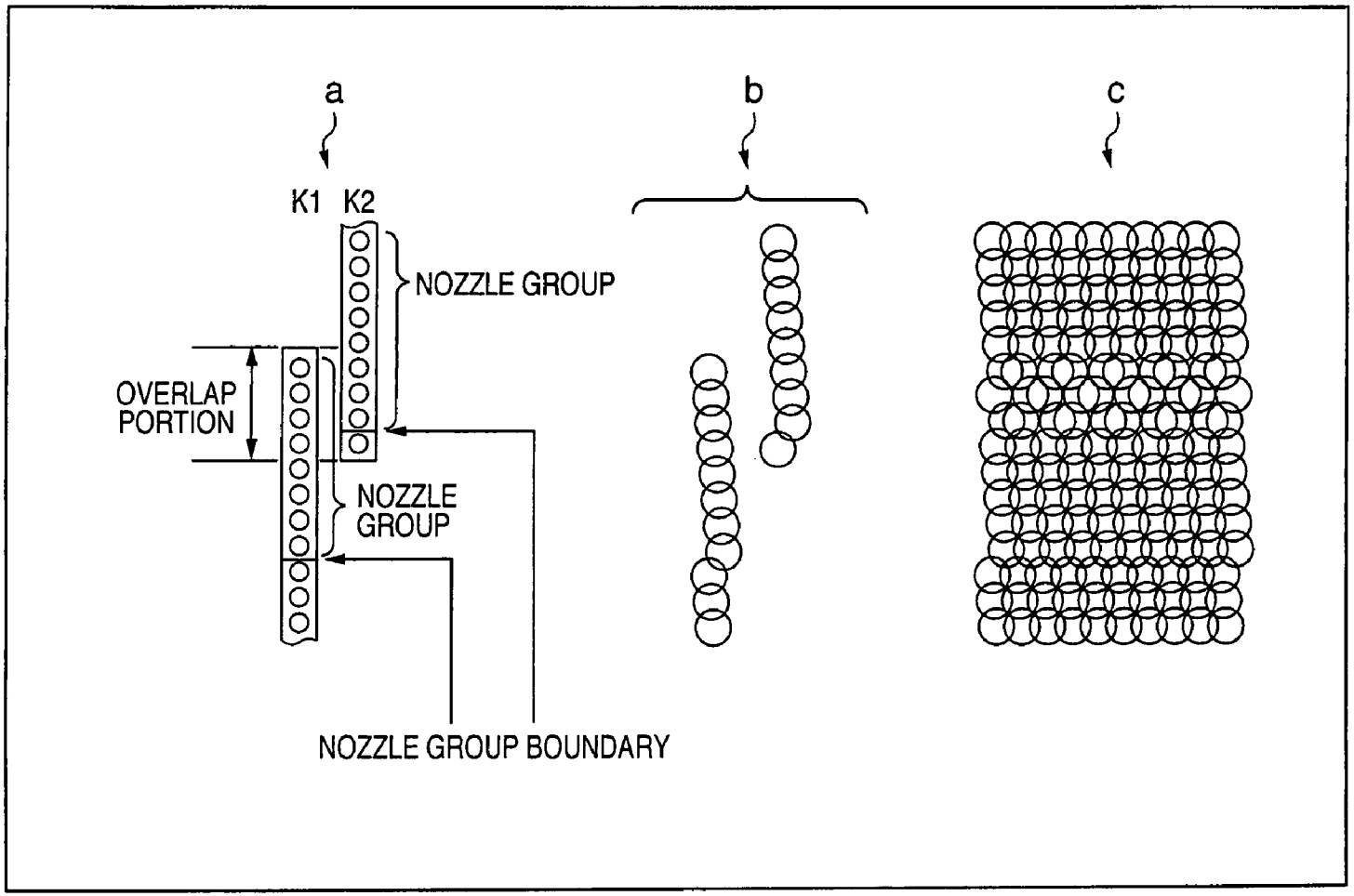
FIG. 14 is a view showing printing that is executed by the same nozzle array arrangement as in the printhead shown in FIG. 12 without adjusting the nozzle driving sequences of the overlap portion in time divisional driving.

FIG. 14 is a view showing a result of printing that is executed by the same nozzle array arrangement as indicated by a in FIG. 12 without making the nozzle driving sequences of the blocks in time divisional driving coincident between two nozzle arrays.

As indicated by a in FIG. 14, the nozzle arrays are the same as those indicated by a in FIG. 12. However, as indicated by b in FIG. 14, the nozzle driving sequence in each block in time divisional driving differs between the two nozzle arrays. That is, in the example indicated by b in FIG. 14, the plurality of nozzle groups of the two nozzle arrays include nozzles in equal number (eight). The boundary between the nozzle groups is present in the overlap portion. Hence, if mutual complementary printing is to be executed by the two nozzle arrays in the overlap portion, the driving sequence of nozzles belonging to the overlap portion shifts. A printing result indicated by c in FIG. 14 is obtained. In this case, printed dots in the overlap portion are not arrayed in order, resulting in poor print quality.

As described above, according to this embodiment, in time divisional driving of a "bonded-head line type" printhead employing an "overlap" printing method, the driving sequences of nozzles (print elements) belonging to the overlap portion are made coincident between different nozzle arrays. With this arrangement, the printed dots formed in the overlap portion are arrayed in order, and high-quality printing can be achieved.

In the above-described example, a single printhead is used. However, the present invention is not limited to this, and a plurality of printheads may be used. Modifications to this embodiment in which two printheads are used will be described below.

First Modification to Second Embodiment

Figure 15:
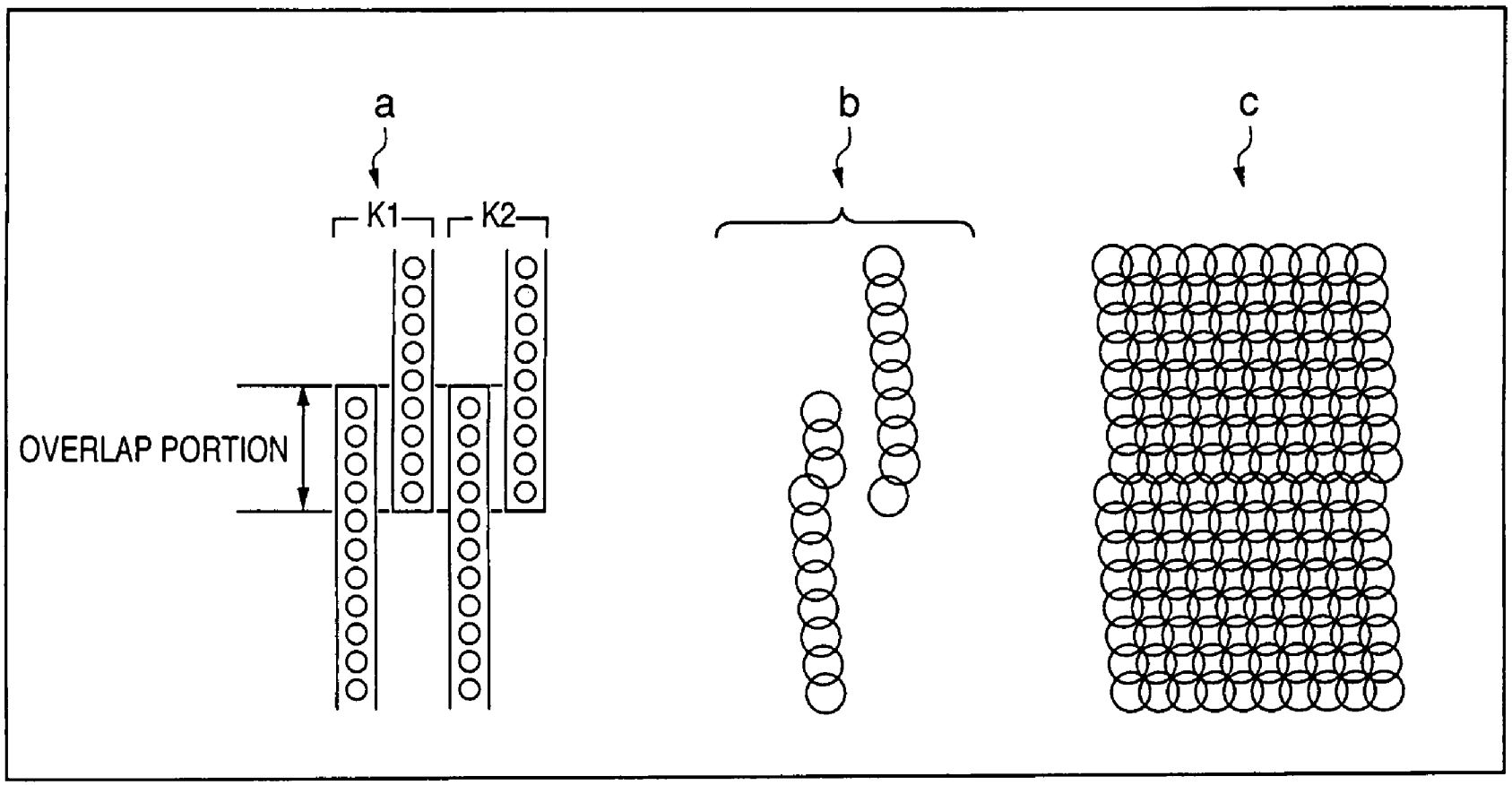
FIG. 15 is a view showing printing using the two printheads K1 and K2 each including a plurality of nozzle arrays according to the first modification to the second embodiment.

FIG. 15 is a view showing printing using two printheads K1 and K2 each including a plurality of nozzle arrays.

As indicated by a in FIG. 15, parts of the nozzle arrays in the two printheads K1 and K2 are overlapped such that printing can be executed at the same position on a printing medium even at a joint between the nozzle arrays. In mutual complementary printing by the two printheads K1 and K2 each having two nozzle arrays, i.e., by the four nozzle arrays in the overlap portions, the following control is executed. In time divisional driving, the driving sequences of nozzles of blocks belonging to the overlap portions are arranged to be the same between different nozzle arrays, as indicated by b in FIG. 15. With this arrangement, the printed dots in the overlap portions are arrayed in order, as indicated by c in FIG. 15. Consequently, a high-quality printed image can be obtained.

Second Modification to Second Embodiment

Figure 16:
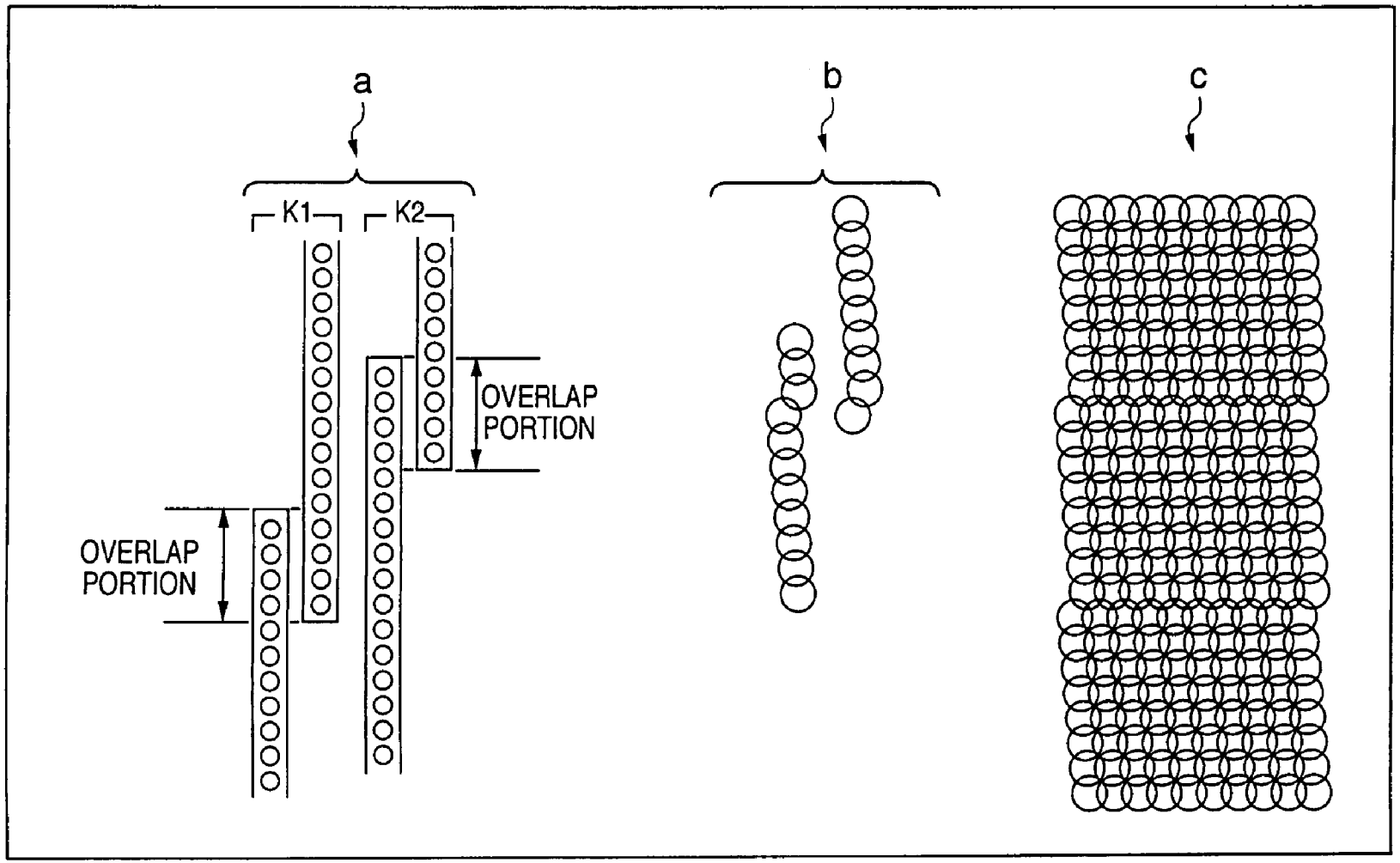
FIG. 16 is a view showing printing using the two printheads K1 and K2 each including a plurality of nozzle arrays according to the second modification to the second embodiment.
Figure 17:
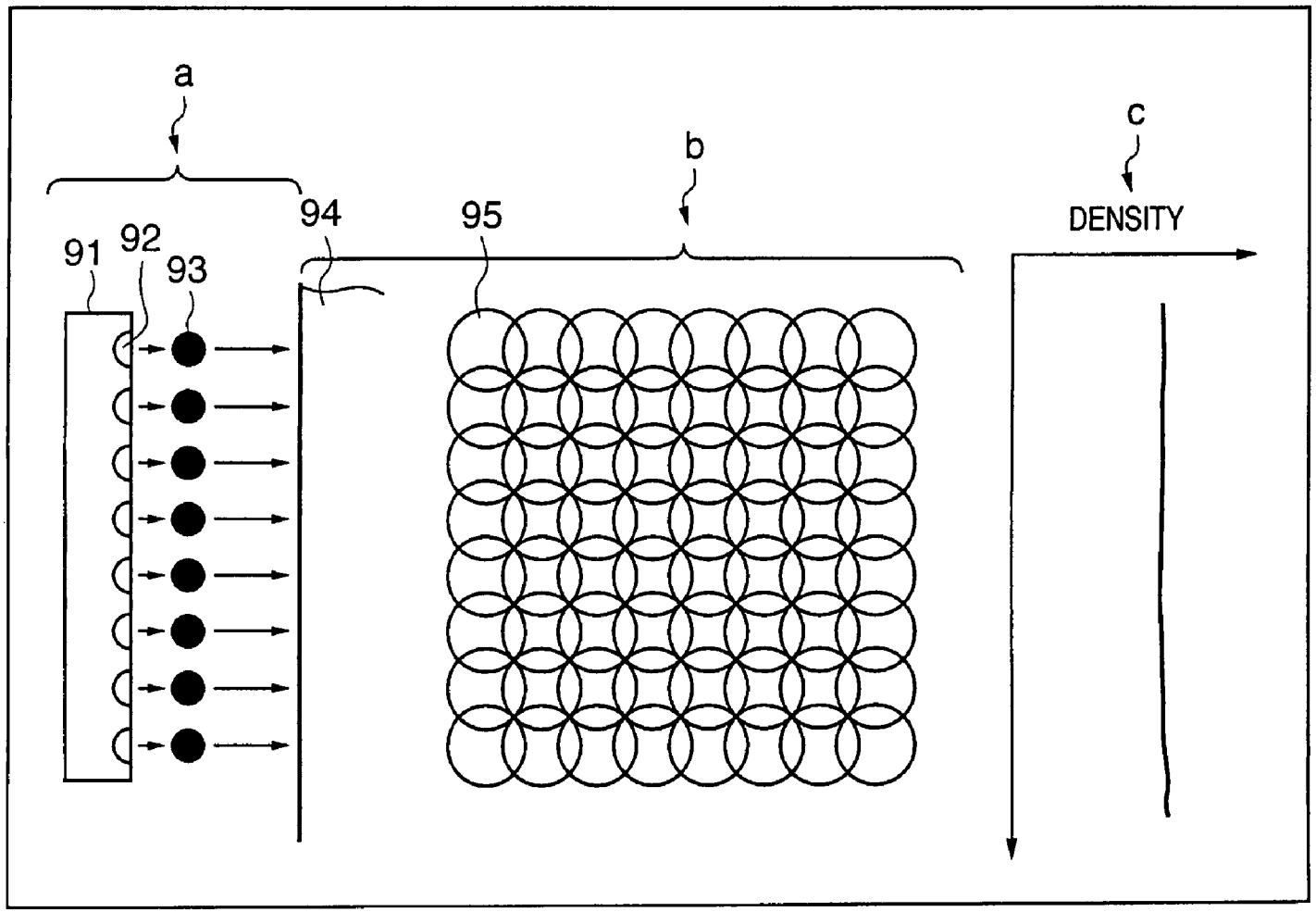
FIG. 17 is a view showing an image density when ink is properly discharged.
Figure 18:
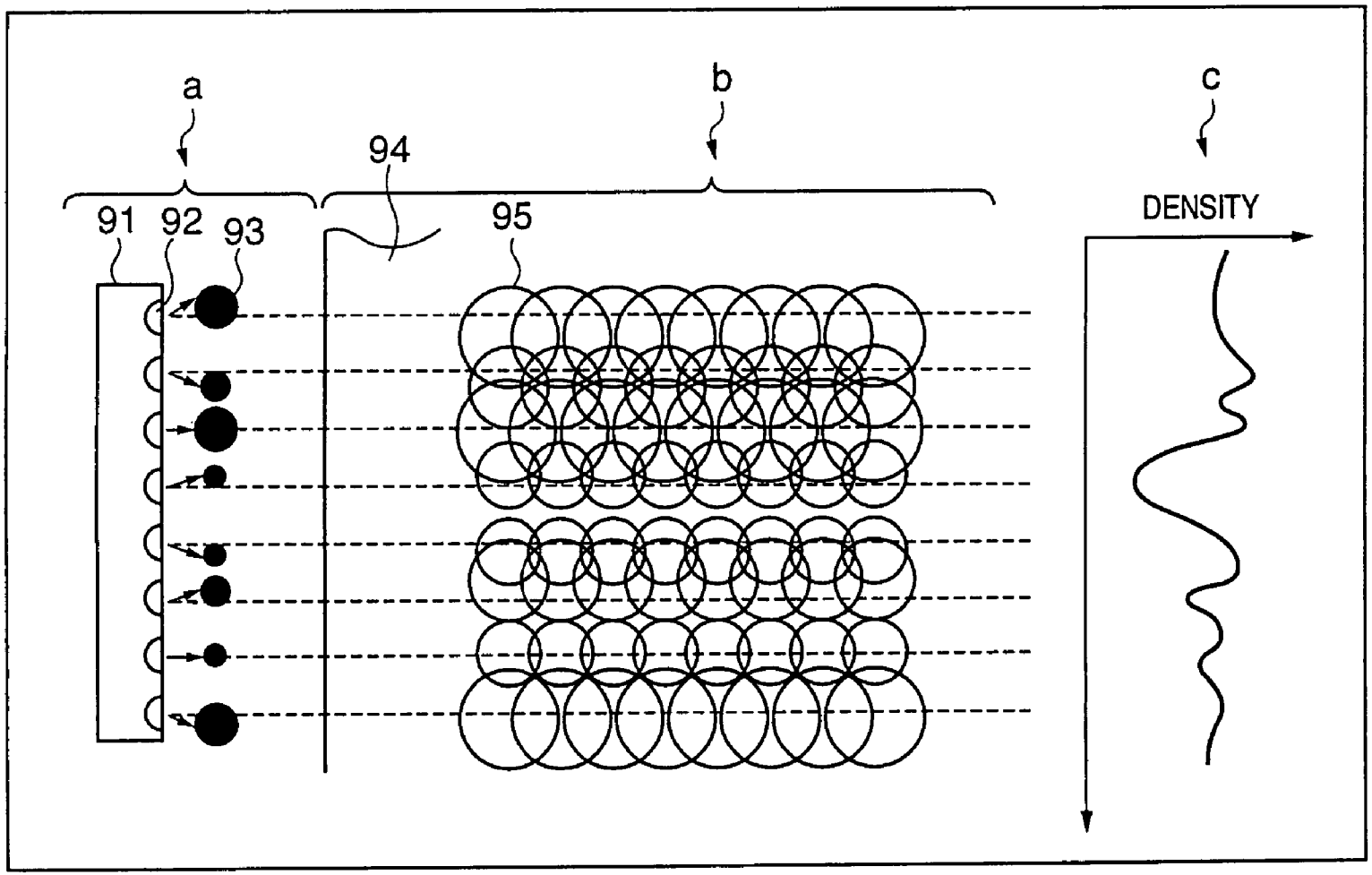
FIG. 18 is a view showing an image density when abnormal printing occurs in an ink discharge amount and direction.

FIG. 16 is a view showing printing using the two printheads K1 and K2 each including a plurality of nozzle arrays.

As indicated by a in FIG. 16, parts of the nozzle arrays in the two printheads K1 and K2 are overlapped such that printing can be executed at the same position on a printing medium even at a joint between the nozzle arrays. As is apparent by comparing this arrangement to a in FIG. 15,.in this modification, the overlap portion of the printhead K1 and that of the printhead K2 are shifted from each other.

In mutual complementary printing by the two printheads K1 and K2 each having two nozzle arrays, i.e., by the four nozzle arrays in the overlap portions, the following control is executed. In time divisional driving, the driving sequences of nozzles of blocks belonging to the overlap portions are arranged to be the same between different nozzle arrays, as indicated by b in FIG. 16. With this arrangement, the printed dots in the overlap portions are arrayed in order, as indicated by c in FIG. 16. Consequently, a high-quality printed image can be obtained.

Even in the first and second modifications, the same type of print element substrates can be mass-produced and arrayed to form a full-line printhead for cost reduction. In this case, the print element substrates are arrayed as shown in FIG. 13 already described.

In the above-described embodiments, a droplet discharged from a printhead is ink, and a liquid contained in the ink tank is ink. However, the contained substance is not limited to ink. For example, a liquid like a processed liquid that is discharged to a printing medium to increase the fixing property or water repellency of a printed image or its image quality may be contained in the ink tank.

The above-described embodiments especially employ, of inkjet printing methods, a method of causing a state change in ink by thermal energy generated by using a means (e.g., an electrothermal transducer or laser beam) for generating thermal energy as energy to be used for ink discharge, thereby increasing the printing density and resolution.

In addition, the inkjet printing apparatus of the present invention can take not only a form of an image output apparatus of an information processing device such as a computer but also a form of a copying machine combined with a reader or a facsimile apparatus having transmission and reception functions.

As many apparently widely different embodiments of the present invention can be made without departing from the spirit and scope thereof, it is to be understood that the invention is not limited to the specific embodiments thereof except as defined in the appended claims.

This application claims the benefit of Japanese Patent Application No. 2005-161423 filed on Jun. 1, 2005, which is hereby incorporated by reference herein in its entirety.

What is claimed is:

1. A printing apparatus for executing printing by arranging plural printheads, each including a plurality of print elements in a direction of a print width so as to obtain the print width corresponding to a width of a printing medium and conveying the printing medium in a direction perpendicular to the direction of the print width, wherein printing positions of part of the print elements of a first printhead in the direction of the print width overlap with part of the print elements of a second printhead in the direction of the print width, comprising:

conveyance means for conveying the printing medium;

mutual complementary printing means for performing mutual complementary printing in the overlap portion by the overlapped print elements; and time divisional driving control means for dividing the plurality of print elements of each of the plural printheads into a plurality of blocks, with each block composed of a predetermined number of print elements, and time-divisionally driving the predetermined number of print elements included in each block, wherein the predetermined number differs from a number of print elements included in the overlap portion, and said time divisional driving control means controls driving sequences of the overlapped print elements of the plural printheads to coincide with each other.

2. The apparatus according to claim 1, wherein the plural printheads are arranged in the conveyance direction of the printing medium.

3. The apparatus according to claim 1, wherein the print elements included in the overlap portion discharge the same color ink.

4. The apparatus according to claim 1, wherein each of the plural printheads is formed by providing the plurality of print elements on one print element substrate.

5. The apparatus according to claim 1, wherein each of the plural printheads is formed by bonding a plurality of print element substrates, each including print elements smaller in number than the plurality of print elements.

6. The apparatus according to claim 5, wherein a joint between the plurality of print element substrates matches an end of the block for time divisional driving.

7. The apparatus according to claim 5, wherein a plurality of print element arrays, each including a plurality of print elements, are formed in a single printhead, and at least part of the plurality of print element arrays are overlapped in the conveyance direction of the printing medium.

8. The apparatus according to claim 1, wherein each of the plural printheads comprises electrothermal transducers to generate thermal energy to be given to the ink to discharge ink by using the thermal energy.

9. A printing method of executing printing by arranging plural printheads, each including a plurality of print elements in a direction of a print width so as to obtain the print width corresponding to a width of a printing medium and conveying the printing medium in a direction perpendicular to the direction of the print width, wherein printing positions of part of the print elements of a first printhead in the direction of the print width overlap with part of the print elements of a second printhead in the direction of the print width, comprising:

a mutual complementary printing step of performing mutual complementary printing in the overlap portion by the overlapped print elements; and a time divisional driving control step of dividing the plurality of print elements of each of the plural printheads into a plurality of blocks, each composed of a predetermined number of print elements, and time-divisionally driving the predetermined number of print elements included in each block, wherein the predetermined number differs from a number of print elements included in the overlap portion, and said time divisional driving control step controls driving sequences of the overlapped print elements of the plural printheads to coincide with each other.

* * * * *